United States Patent [19]

Adachi

[11] 4,111,092

[45] Sep. 5, 1978

[54] ELECTRONIC MUSICAL INSTRUMENT

[75] Inventor: Takeshi Adachi, Hamamatsu, Japan

[73] Assignee: Nippon Gakki Seizo Kabushiki Kaisha, Japan

[21] Appl. No.: 772,693

[22] Filed: Feb. 28, 1977

[30] Foreign Application Priority Data

Mar. 4, 1976 [JP] Japan ..... 51-25556[U]

[51] Int. Cl.[2] ..... G10H 1/02

[52] U.S. Cl. ..... 84/1.27; 84/1.11; 84/1.24

[58] Field of Search ..... 84/1.01, 1.03, 1.09, 84/1.10, 1.13, 1.24, 1.26, 1.11, 1.12, 1.19, 1.20, 1.21, 1.22, 1.23

[56] References Cited

U.S. PATENT DOCUMENTS

| | | | |
|---|---|---|---|
| 3,886,836 | 6/1975 | Hiyoshi | 84/1.13 |
| 3,916,750 | 11/1975 | Uetrecht | 84/1.03 |
| 3,922,943 | 12/1975 | Niinomi | 84/1.19 |
| 3,981,217 | 9/1976 | Oya | 84/1.03 |
| 3,999,458 | 12/1976 | Suzuki | 84/1.01 |
| 4,012,980 | 3/1977 | Suzuki | 84/1.01 |
| 4,018,125 | 4/1977 | Nishiomoto | 84/1.19 |

*Primary Examiner*—Robert K. Schaefer
*Assistant Examiner*—William L. Feeney
*Attorney, Agent, or Firm*—Ladas, Parry, Von Gehr, Goldsmith & Deschamps

[57] ABSTRACT

In an electronic musical instrument a key touch signal is generated in response to the operation of a key, and a plurality of control signals having different waveforms are produced from the key touch signal.

Different control signals are used for independently controlling at least two of a plurality of musical tone elements that determine the tone pitch, color and volume of the musical tone generated by the musical instrument.

9 Claims, 4 Drawing Figures

KEYBOARD
10
TOUCH SENSOR (C1)
11-1
TOUCH SENSOR (C1#)
11-2
TOUCH SENSOR (C6)
11-61
11
N1
N61
KEY GATE
12
H1
H8
CHANNEL GATE AND HOLD
13
L1
L2
L8
WAVEFORM CONVERTER
14-1
14-2
14-8
1a 1b 1c 1d
2a 2b 2c 2d
8a 8b 8c 8d
Va Vb Vc Vd
VCA
1a
2a
8a
M1a
M2a
M8a
Va
LEVEL ADJUSTING GATE CIRCUIT
15
M1a M1b M1c M1d
M2a M2b M2c M2d
M8a M8b M8c M8d
TO MUSICAL SOUND SYNTHESIZING CIRCUITS 16 OF RESPECTIVE CHANNELS

ELECTRONIC MUSICAL INSTRUMENT

BACKGROUND OF THE INVENTION

This invention relates to an electronic musical instrument, and more particularly to a touch control thereof.

Where a key touch such as a key operating speed or pressure is detected for generating a key touch signal which is used for controlling various musical tone elements, for example, the tone pitch, color and volume of the musical tone, in a prior art control circuit only one control signal has been produced from one key touch signal so that when the control signal is used to simultaneously control a plurality of musical tone elements, the tone pitch, color and volume of the musical tone vary in the same pattern.

SUMMARY OF THE INVENTION

It is an object of this invention to provide an electronic musical instrument wherein a plurality of musical tone elements are controlled independently in response to a key touch for realizing a complicated touch control to give variety to the musical tone.

According to this invention, there is provided an electronic musical instrument comprising a keyboard including a plurality of keys, means for detecting key touch of a depressed key for generating a key touch signal, a waveform converting circuit means responsive to the key touch signal for producing a plurality of control signals having different waveforms, circuit means responsive to different control signals for independently controlling at least two of a plurality of musical tone elements that determine the tone pitch, color and volume of the musical tone generated by the musical instrument.

DESCRIPTION OF THE PREFERRED EMBODIMENT

Figure 1:
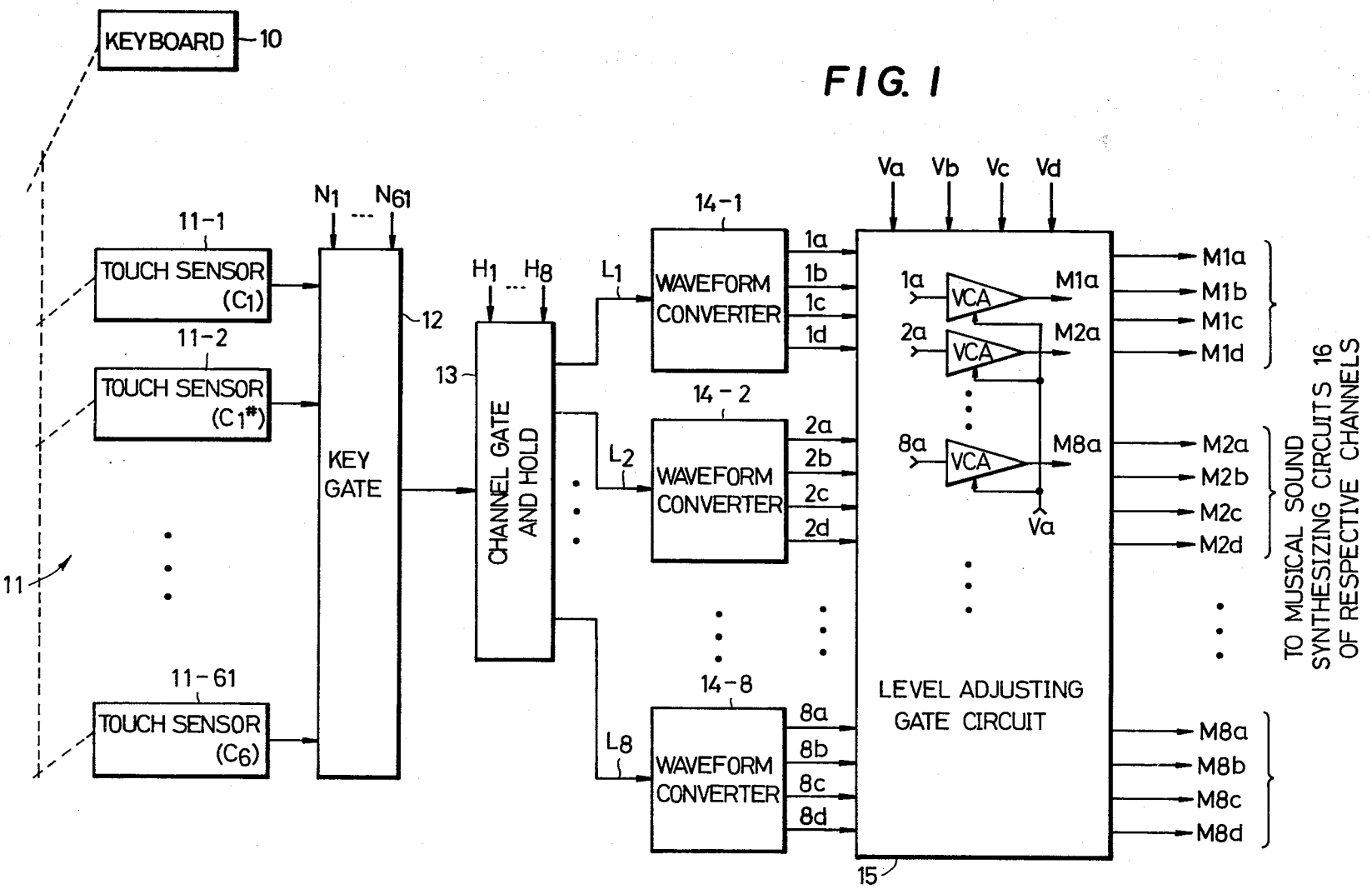
FIG. 1 is a block diagram showing the path of the signals from key touch sensors to waveform converting circuits for key touch signals.

In a preferred embodiment of this invention illustrated in FIG. 1, a plurality of touch sensors 11-1 through 11-61 are provided corresponding to respective keys of a keyboard. Each touch sensor is constructed to produce an analogue key touch signal in response to a predetermined key touch such as a key depressing speed or a key depressing pressure. A key gate 12 is provided to receive the outputs from respective touch sensors 11-1 through 11-61 and key gate control signals N1 through N61 corresponding to respective keys for applying an output to a channel gate and hold circuit 13. This circuit 13 is controlled by channel gate control signals H1 through H8 corresponding to respective channels of the maximum number of tones to be produced simultaneously. Signals H1 through H8 successively produce pulses corresponding to the time sharing time slots of respective channels. A tone producing channel is assigned to a depressed key by a key assigner, not shown, and a key gate control signal (one of N1 through N61) corresponding to that key produces a pulse for controlling the key gate 12 in synchronism with a signal (one of H1 through H8) of the assigned channel. The signals H1 through H8 serve as channel gate control signals for the channel gate and hold circuit 13. As a consequence, a key touch signal is produced by a touch sensor 11 corresponding to a depressed key on a time sharing basis in synchronism with the time slot of a channel to which the tone production for the key has been assigned. The key touch signal is stored in a hold circuit (for example, a capacitor) corresponding to that channel in the channel gate and hold circuit 13 so that the key touch signals from touch sensors corresponding to keys assigned to the channels are provided on output lines L1 through L8 corresponding to respective channels.

There are provided a plurality of waveform converting circuits 14-1 through 14-8 of the same construction for respective channels for converting the key touch signals supplied to respective output lines L1 through L8 into a plurality of waveforms of different types (control waveforms). For example, waveforms 1*a*, 2*a* . . . 8*a* are formed by integrating respective input key touch signals, waveforms 1*b*, 2*b* . . . 8*b* produced by converting respective input key touch signals into rectangular waveforms, waveforms 1*c*, 2*c* . . . 8*c* are formed by differentiating respective input key touch signals, and waveforms 1*d*, 2*d* . . . 8*d* are formed by inverting the differentiated waveforms 1*c*, 2*c* . . . 8*c*.

Figure 2:
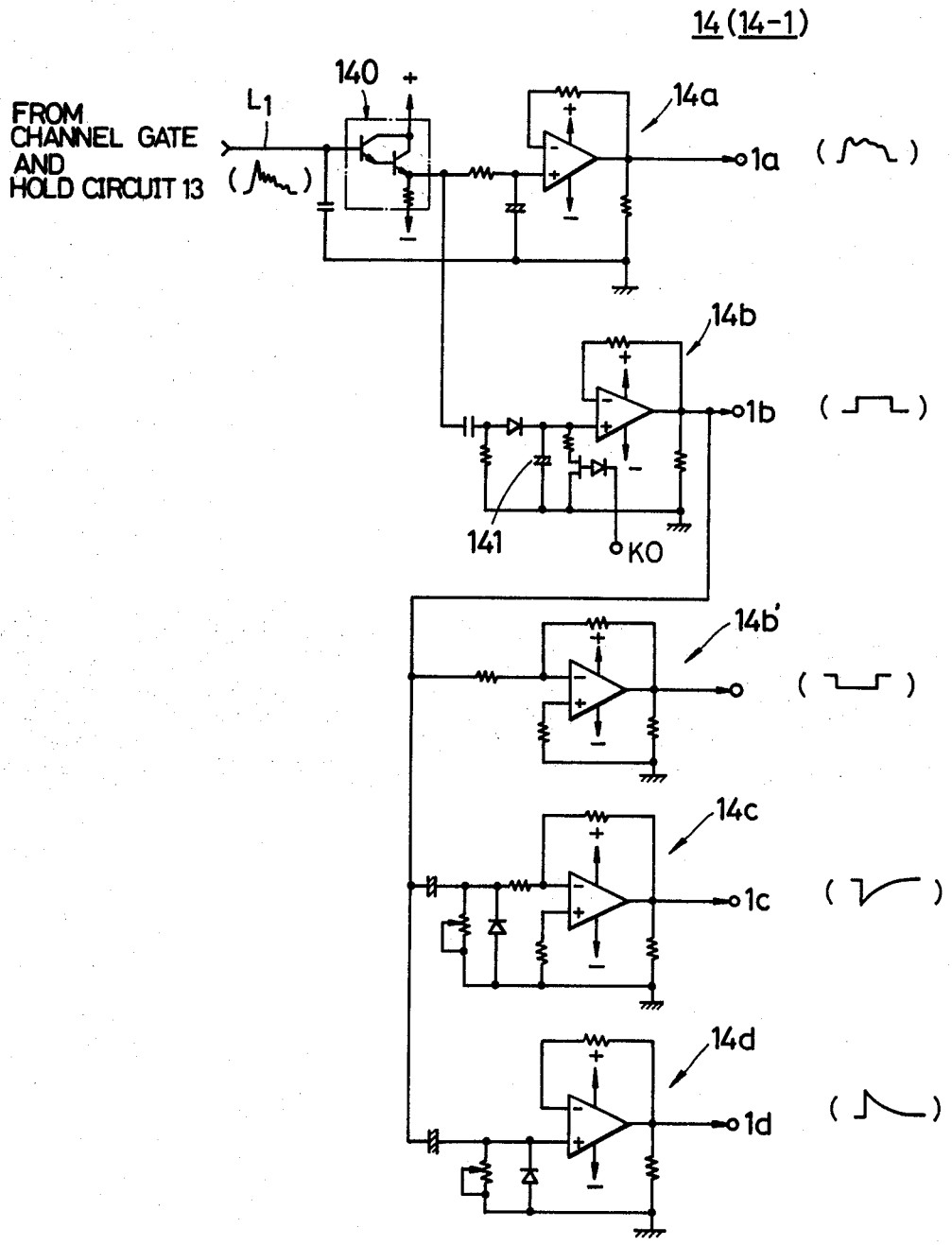
FIG. 2 is a connection diagram showing the detail of the waveform converting circuit.
Figure 3:
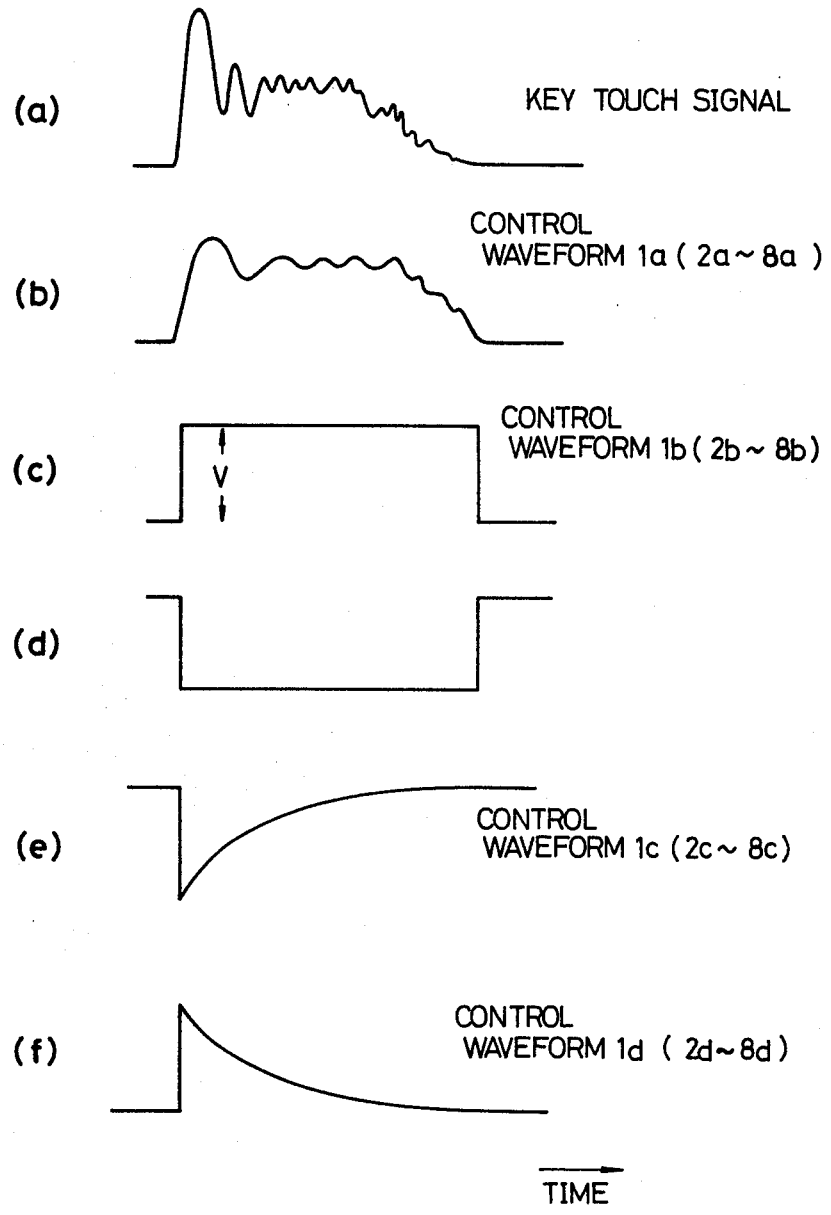
FIG. 3 is a graph showing one example of the input and output waveforms of the circuit shown in FIG. 2.

FIG. 2 shows one example of the waveform converting circuit 14-1. Suppose now that a key touch signal as shown in FIG. 3(*a*) is applied from the channel gate and hold circuit 13 through output line L1. The applied touch signal is applied to two waveform converters 14*a* and 14*b* through an input circuit 140 provided with a high input impedance by transistors of Darlington connection. The converter 14*a* is constituted by an integrating circuit so that it produces an integrated waveform 1*a* (2*a*–8*a*) which substantially follows the variation in the input key touch signal as shown in FIG. 3(*b*). The waveform converter 14*b* is constituted by a combination of a differentiating circuit and a hold circuit so that it differentiates the rise portion of the input key touch signal and the differentiated output V is held by a capacitor 141 to obtain a rectangular waveform 1*b* (2*b*–8*b*) as shown in FIG. 3(*c*). The capacitor 141 is discharged by a keying signal KO when the operated key is released. The output waveform of the waveform converter 14*b* is inverted by the waveform converter 14*b*' as shown in FIG. 3(*d*). If desired, this inverted rectangular waveform can also be used to control the musical tone. The output from the waveform converter 14*b* is applied to waveform converters 14*c* and 14*d*. The waveform converter 14*c* comprises a combination of a differentiating circuit and an inverting amplifier and produces a negative differentiated waveform 1*c* (2*c*–8*c*) as shown in FIG. 3(*e*). The waveform converter 14*d* comprises a combination of a differentiating circuit and a non-inverting amplifier and produces a positive differentiated waveform 1*d* (2*d*–8*d*) as shown in FIG. 3(*f*).

The control waveforms 1*a* through 8*a* substantially correspond to the waveform variations (key touch variations) of the key touch signals. The level V of the control waveforms 1*b* through 8*b* correspond to the rise portions of the key touch signals, and athe maximum levels of the control waveforms 1c through 8c and 1d through 8d correspond to the steady state level V of the rectangular waveforms 1b through 8b. In this manner, the control waveforms obtained by converting the waveform of the key touch signal corresponds to either one of the characteristics of the original key touch signal.

A plurality of control waveforms 1a through 1d (. . . 8a through 8d) obtained from one key touch signal are respectively applied to a level adjusting gate circuit 15 for independently adjusting this amplitude levels (FIG. 1). Thus the amplitude levels of the control waveforms 1a–8a, 1b–8b, 1c–8c and 1d–8d are controlled by control voltages V*a*, V*b*, V*c* and V*d* respectively. The level adjusting gate circuit 15 is provided with voltage-controlled type amplifiers (VCA) or an analogue gate circuits for respective control waveforms 1a through 8d. The gain of the amplifiers is controlled in accordance with the control voltages V*a* through V*d* respectively. One example of the level adjusting gate circuit 15 is shown in its block in FIG. 1. The control waves 1a–1d, 2a–2d, . . . 8a–8d whose levels have been adjusted by the level adjusting gate circuit 15 are designated by M1*a*-,-M1*d*, M2*a*–M2*d* . . . M8*a*–M8*d*, respectively. These level adjusted control waveforms have the same waveforms as the input waveforms shown in FIGS. 3(*b*) through 3(*f*) but are different in their amplitude levels. The levels of the adjusted control waveforms are to be equal to each other. However, it is possible to cut off input waveforms 1a through 1d . . . 8a through 8d by controlling the values of the control voltages V*a* through V*d*, for example reducing to zero thereby to prevent output waveforms M1*a* through M1*d* . . . M8*a* through M8*d* from being generated. In this manner, by controlling the control voltages, it is possible to use any desired control waveforms M1*a* through M8*d* having desired levels, preferably the same level, for the control of musical tones.

The touch control waveforms M1*a* through M1*d* . . . M8*a* through M8*d* are applied to musical tone synthesizing circuits 16 corresponding to respective channels so as to control various musical tone elements determining the tone pitch, color and volume of the musical tone, the musical tone elements including the shape of the waveform of a tone source, the frequency of the musical tone, the characteristics of the tone controlling filter, the tone volume amplitude envelope, the vibrate and the tremolo.

Figure 4:
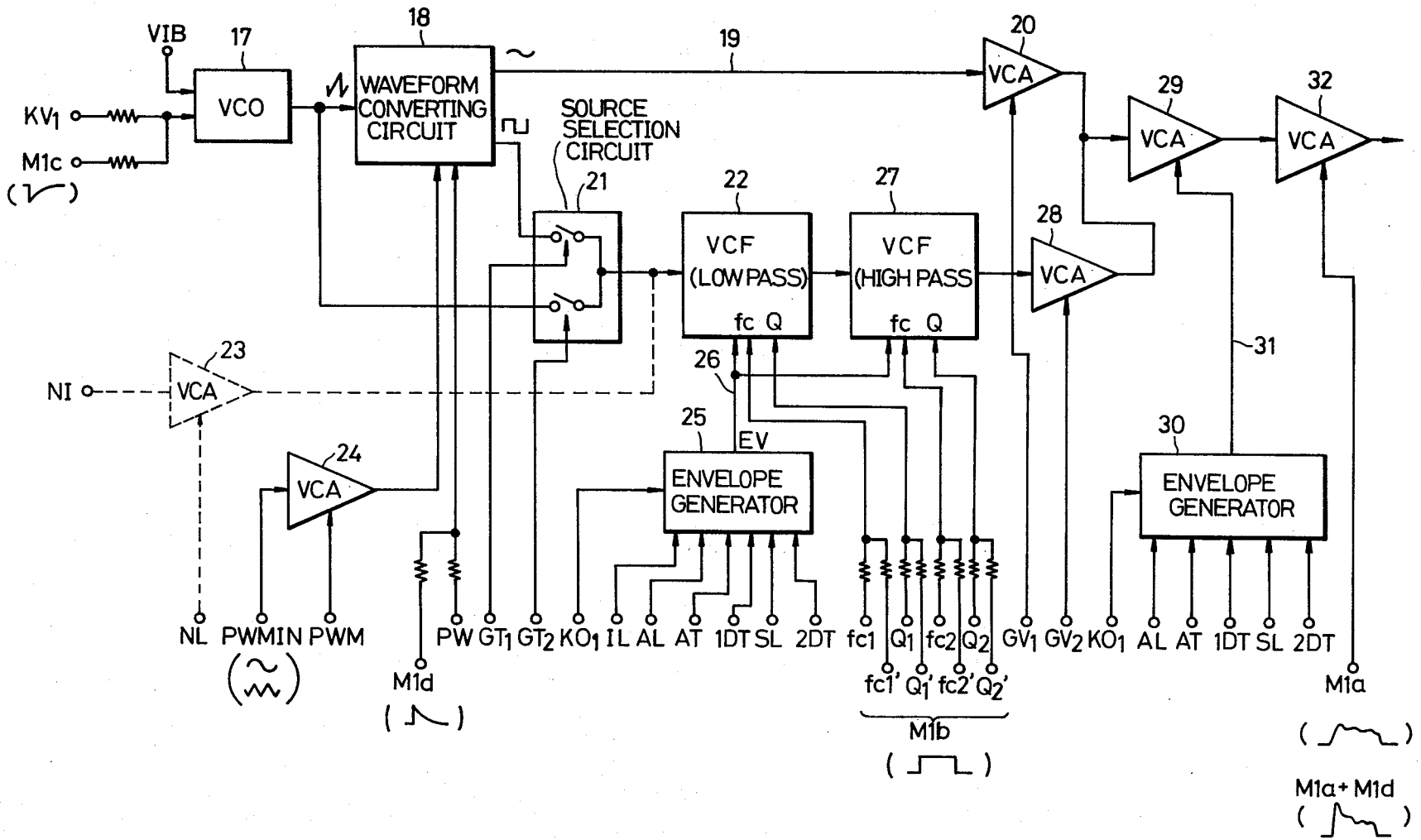
FIG. 4 is a block diagram showing one example of a musical tone synthesizing circuit in which a plurality of control waveforms obtained from the key touch signal are used for controlling the musical tone.

Taking the first channel as an example, one example of the musical tone synthesizing circuit 16 is shown in FIG. 4. A pitch voltage KV1 corresponds to the frequency (tone pitch) of a depressed key of the keyboard 10 shown in FIG. 1 and generated by a pitch voltage generating circuit, not shown, for controlling the oscillation frequency of the voltage-controlled type oscillator (VCO) 17. In response to the pitch voltage KV1, the voltage-controlled type oscillator 17 generates a tone source signal (a saw tooth waveform, for example) having a fundamental frequency of the depressed key. The control waveform M1*c* (FIG. 3(*e*)) is mixed with the pitch voltage KV1 and the mixed voltage is applied to the voltage-controlled type oscillator 17. Accordingly, the pitch of the generated tone is controlled with time according to the shape of the control waveform M1*c*. In other words, although at the start of the tone generation, the pitch of the tone is lower than the normal pitch, it increases gradually thereafter, thus manifesting a glide effect.

The vibrato control signal VIB is applied to the voltage-controlled type oscillator 17 when a vibrate effect is desired, and it is possible to touch-control the vibrato through modulation of the vibrato control signal VIB by controlling a vibrato oscillator, not shown, with one of the touch control waveforms M1*a* through M1*d*.

The waveform converting circuit 18 operates to convert a tone source saw tooth wave signal from the oscillator 17 into a sine wave signal and a rectangular wave signal having the same frequency. The sine wave signal is applied to a voltage-controlled type amplifier (VCA) 20 through a line 19, whereas the rectangular wave signal is applied to the tone selection circuit 21. When selected by a selection control signal GT1, the rectangular wave signal is applied to a voltage-controlled type filter (VCF) 22. A selection control signal GT2 selects the saw tooth wave signal from the oscillator 17 as a tone source and applies it to the voltage-controlled type filter 22.

Where a noise signal NI is used, the noise level is controlled by a voltage-controlled type amplifier (VCA) 23 in accordance with a noise level control signal NL applied thereto and tehn the noise signal NI is applied to the voltage-controlled type filter 22 as shown by dotted lines in FIG. 4.

The duty ratio of the rectangular wave signal produced by the waveform converting circuit 18 can be controlled by a duty ratio control voltage PW. The control waveform M1*d* (FIG. 3(*f*) is admixed with the control voltage PW and then applied to the waveform converting circuit 18. Then it is possible to vary with time the duty ratio of the rectangular wave signal according to the shape of the control waveform M2*d* thereby to control the higher harmonic components contained in the tone source signal in accordance with the key touch. Where it is desired to periodically vary the duty cycle, the amplitude of a pulse width modulation signal PWMIN ( a sinusoidal or triangular wave) is suitably controlled by a voltage-controlled type amplifier 24 in accordance with a control voltage PWM, and then the pulse width modulation signal is applied to the duty ratio control input terminal of the waveform converting circuit 18.

The voltage-controlled type filter 22 comprises a low pass filter, for example, and its cut-off frequency *fc* is variably controlled with time by an envelope control voltage EV applied to its control input over a line 26 from an envelope shape generating circuit 25. The filter 22 is also supplied with another cut-off frequency control voltage *fc*1 (for example, for controlling a steady tone) and a control voltage Q1 for controlling the Q of the filter. Aforementioned control waveform M1*b* shown in FIG. 3(*c*) is used as the cut-off frequency control voltage *fc*1′ and the Q control voltage Q′1, and is admixed with each of the control voltage *fc*1 and Q1 to form control voltages for the filter 22. With this measure, it is possible to control the cut-off frequency *fc* and Q of the low pass filter 22 in accordance with the key touch (strength of the key touch, for example). Since the control waveform M1*b* is rectangular, a steady (i.e., not varying with time) tone can be controlled in accordance with the key touch.

The output from the voltage-controlled type low pass filter 22 is applied to a voltage controlled type high pass filter 27 which is also supplied with an envelope control voltage EV from the envelope shape generating circuit 25 whereby the cut-off frequency *fc* of the high pase filter is varied with time in accordance with the envelope control voltage. For the purpose of steadily controlling the cut-off frequency and the Q of the high pass filter 27, a cut-off frequency control voltage *fc*2 and a control voltage Q2 are also applied to the control input of the filter 27. The control waveform M1*b* is used as the control voltage *fc*2 and the Q control voltage Q'2 which are admixed with the control voltage *fc*2 and Q2.

Accordingly, the cut-off frequency and the Q of the high pass filter 27 are controlled by the key touch. The voltage-controlled type low and high pass filters 22 and 27 thus constitute a bandpass filter.

The envelope shape generating circuit 25 receives a key ON signal KO1 produced during the depression of the key, and then generates a series of envelope amplitude waveforms including attack (rise), sustain and decay. The envelope shape generating circuit 25 is supplied with an initial level control signal IL which sets the level of the envelope at the start thereof, an attack level control signal AL which sets the maximum level of the rise portion (attack portion) of the envelope, an attack time control signal AT which sets the duration of the attack, a first decay time control signal IDT which sets the duration of the decay from termination of the attack to initiation of the sustain, a sustain level control signal SL which sets the sustain level and a second decay time control signal 2DT which sets the duration of the decay after termination of the sustain (i.e., at the time of releasing a key). Accordingly, the envelope signal EV is variably controlled in accordance with these control signals thereby variously controlling the manner of varying the tone with time. As the envelope shape generating circuit may be used those disclosed in the U.S. Pat. No. 3,897,709.

The output of the voltage-controlled filter 27, that is the tone source signal with the higher harmonic components suitably controlled, is applied to a voltage-controlled type amplifier (VCA) 28. A sine wave signal substantially free from any higher harmonic components is applied to the voltage-controlled type amplifier 20 over the line 19. The gains of the amplifiers 20 and 28 are controlled by gain control voltages GV1 and GV2 respectively, and the mixture of the outputs of these amplifiers are applied to a voltage-controlled type amplifier 29.

The purpose of the voltage-controlled type amplifier 29 is to control the amplitude envelope of the musical tone and its gain is controlled in accordance with an envelope control voltage supplied from an envelope shape generating circuit 30 through a line 31, thereby controlling the amplitude envelope of the musical tone signal. The envelope shape generating circuit 30 which generates a series of an envelope control voltage including attack, sustain and decay portions has substantially the same construction as the envelope shape generating circuit 25 for filters 22 and 27.

The music signal applied with the amplitude envelope is supplied to the voltage-controlled type amplitude (VCA) 32. Since the control waveform M1*a* (FIG. 3(*b*)) is applied to the gain input of the amplifier 32 for controlling the gain thereof, the amplitude envelope of the musical tone is controlled further in accordance with the shape of the control waveform M1*a*. In this manner, it is possible to control with time the volume of the musical tone in accordance with the key touch. The gain of the voltage-controlled amplifier 32 may be controlled by a signal obtained by mixing together the control waveforms 1M1*a* and M1*d*. Then the control waveform M1*d* gives an attack type amplitude envelope. In this case, when the key touch is periodically varied during the key depression (where the touch sensor 11 comprises a piezo-electric element the strength of a key depressing force is periodically varied, whereas in the case where the touch sensor 11 comprises a key displacement detector the key is vibrated in the lateral direction), the amplitude of the envelope of the key touch signal (see FIG. 3(*a*) produced by the touch sensor 11 varies cyclically, and the amplitude of the envelope of the control waveform M1*a* also varies cyclically. As a consequence, the voltage-controlled amplifier 32 can produce an effect resembling tremolo.

In the above described embodiment, a plurality of different control waveforms M1*a* through M1*d* are formed from one key touch signal for variably and independently controlling the higher harmonic components contained in the tone source signal, the filter cut-off frequency, the Q of the filter, the amplitude envelope (volume) of the musical tone and the pitch of the musical tone. However, the musical tone elements controlled by the control waveforms M1*a* through M1*d* are not limited to those described just above but modulations of other various elements (for example, signals NL, PWM, IL, AL, AT, IDT, SL 2DT, etc.) can also be controlled.

Although the musical tone synthesizing circuit only in the first channel is shown in FIG. 4, the musical tone synthesizing circuits of the other channels are identical to that shown in FIG. 4 so that control waveforms M2*a*–M2*d* . . . M8*a*–M8*d* are similarly used for the control of the musical tone.

As above described, according to this invention, a plurality of different control signals are formed from one key touch signal and these control signals are used for the control of different component elements of the musical tone so that it is possible to produce a musical tone signal which varies in various manners and thereby produce variety in a generated tone in response to a key touch.

What is claimed is:

1. An electronic musical instrument comprising:

(a) a keyboard including a plurality of keys, each key corresponding to a respective musical tone;

(b) means for detecting a characteristic of the finger touch applied to each key upon depression thereof and producing a first signal corresponding to the depressed key;

(c) waveform converting means having only a single control input in use, said waveform converting means being coupled at said single control input to said detecting means and being responsive to said first signal for producing a plurality of second signals having respectively different waveforms;

(d) level adjusting means connected to said waveform converting means for receiving said second signals and adjusting their respective amplitudes to produce respective level-adjusted second signals; and (e) means responsive to said level-adjusted second signals for individually controlling at least two of a plurality of musical tone elements which determine the tone pitch, color and volume of a musical tone corresponding to the depressed key.

2. An electronic musical instrument according to claim 1, comprising a key gate which couples said detecting means to said waveform converting means, said key gate receiving said first signal and producing a third signal corresponding to said first signal, said third signal being supplied to said single control input for causing said waveform converting means to produce said plurality of second signals received by said level-adjusting means, and means for applying the level-adjusted second signals to a musical tone synthesizing circuit.

3. An electronic musical instrument according to claim 1, in which the level adjusting means adjusts the respective amplitudes of the second signals to the same level.

4. An electronic musical instrument according to claim 1, in which the waveform converting means comprises at least two circuits selected from the group consisting of a differentiating circuit, an integrating circuit, an inverting circuit and a hold circuit.

5. An electronic musical instrument according to claim 2, wherein the key gate receives a plurality of the first signals to produce a plurality of the third signals in a time sharing manner in synchronism with channel control signals provided by channel control signal generating means, and wherein said instrument further comprises a channel gate and hold circuit receiving said third signals to produce fourth signals in respective channels in accordance with said channel control signals, said waveform converting means including a plurality of waveform converting circuits corresponding to the respective channels, each of which produces a plurality of the second signals in response to each of said fourth signals, and said level adjusting means including a plurality of level adjusting circuits corresponding to the respective channels, each of which receives said plurality of second signals for adjusting the amplitudes of the respective second signals individually.

6. An electronic musical instrument according to claim 1, wherein said level adjusting means comprises voltage-controlled type amplifiers of the same number as said second signals.

7. An electronic musical instrument according to claim 2 wherein said waveform converting means comprises an integrating circuit, a first combination of a differentiating circuit with a hold circuit, and a second combination of a differentiating circuit with an inverting amplifier, said second combination being connected to receive the output of said first combination for producing a negative differentiated waveform.

8. An electronic musical instrument according to claim 7, wherein said musical tone synthesizing circuit comprises an inverting circuit connected to invert the output of said first combination, and a differentiating circuit connected to the output of said first combination for producing a positive differentiated waveform.

9. An electronic musical instrument according to claim 2 wherein said musical tone synthesizing circuit comprises a voltage-controlled type oscillator responsive to a pitch voltage corresponding to the depressed key for producing a tone source signal having a fundamental frequency of the depressed key one of said level-adjusted second signals being applied to said voltage-controlled type oscillator for controling said tone source signal, a waveform converting circuit for converting the output of said voltage controlled-type oscillator into a sine wave signal and a rectangular wave signal, a selection circuit for applying one of said output of the oscillator and said rectangular wave signal to a voltage-controlled type filter, and means for synthesizing said sine wave signal and the output from said filter.

* * * * *